US009790009B2

(12) United States Patent
Ledemeney

(10) Patent No.: US 9,790,009 B2
(45) **Date of Patent: *Oct. 17, 2017**

(54) CLOSURE CAPS

(71) Applicant: GREIF INTERNATIONAL HOLDING BV, Vreeland (NL)

(72) Inventor: Sebastien Yves Aldolphe Ledemeney, Sotteville les Rouen (FR)

(73) Assignee: GREIF INTERNATIONAL HOLDING B.V., Vreeland (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/249,311

(22) Filed: Aug. 26, 2016

(65) Prior Publication Data

US 2016/0362235 A1 Dec. 15, 2016

Related U.S. Application Data

(63) Continuation of application No. 14/456,774, filed on Aug. 11, 2014, now Pat. No. 9,434,518, which is a (Continued)

(30) Foreign Application Priority Data

May 14, 2007 (GB) ..... 0709261.2

(51) Int. Cl.
*B65D 51/20* (2006.01)
*B65D 39/08* (2006.01)
(Continued)

(52) U.S. Cl.
CPC ..... *B65D 51/20* (2013.01); *B65D 39/08* (2013.01); *B65D 41/46* (2013.01); *B65D 41/58* (2013.01);
(Continued)

(58) Field of Classification Search
CPC ..... B65D 51/20; B65D 41/58; B65D 41/46; B65D 55/0863; B65D 39/08; B65D 2101/0023
See application file for complete search history.

(56) References Cited

U.S. PATENT DOCUMENTS 1,996,674 A 4/1935 Cross
1,996,682 A 4/1935 O'Brien
(Continued)

FOREIGN PATENT DOCUMENTS

DE 2621117 A1 11/1976
DE 3637644 A1 5/1988
(Continued)

*Primary Examiner* — Anthony Stashick
*Assistant Examiner* — James M Van Buskirk
(74) *Attorney, Agent, or Firm* — Baker & Hostetler LLP

(57) ABSTRACT

A cap for a container closure or closure plug includes a cap top having a top surface and a bottom surface, and an attachment ring extending axially downward from the bottom surface of the cap top under a central portion of the cap top. The attachment ring is securingly engageable with a container closure or closure plug. The attachment ring includes a cam surface extending radially outward from the attachment ring, where the cam surface deflects the attachment ring radially inward upon engagement of the attachment ring with the container closure or closure plug. The cap top and the attachment ring are connected by at least one frangible connection and at least one permanent connection, where the at least one permanent connection retains the cap top in one piece upon breaking of the at least one frangible connection for removal of the cap from the container closure or closure plug.

23 Claims, 5 Drawing Sheets

Related U.S. Application Data continuation of application No. 12/600,162, filed as application No. PCT/GB2008/001668 on May 14, 2008, now Pat. No. 8,813,988.

(51) Int. Cl.
*B65D 41/58* (2006.01)
*B65D 55/08* (2006.01)
*B65D 41/46* (2006.01)

(52) U.S. Cl.
CPC .. *B65D 55/0863* (2013.01); *B65D 2101/0023* (2013.01)

(56) References Cited

U.S. PATENT DOCUMENTS

| | | | |
|---|---|---|---|
| 3,838,785 | A | 10/1974 | Lancesseur |
| 4,520,942 | A | 6/1985 | Dwinell |
| 5,996,833 | A | 12/1999 | Lencioni et al. |
| 6,726,048 | B2 | 4/2004 | Dwinell |
| 2004/0232100 | A1 | 11/2004 | Reidenbach |
| 2005/0121451 | A1 | 6/2005 | Van Bruggen |

FOREIGN PATENT DOCUMENTS

| | | | |
|---|---|---|---|
| DE | 9109185 | U1 | 11/1992 |
| DE | 4221589 | A1 | 1/1993 |
| EP | 0324196 | A2 | 7/1989 |
| EP | 0725013 | A1 | 8/1996 |
| EP | 1342671 | A2 | 9/2003 |
| EP | 1514806 | A2 | 3/2005 |
| EP | 1642843 | A1 | 4/2006 |
| EP | 1657175 | A2 | 5/2006 |
| FR | 2202015 | A | 5/1974 |
| GB | 1386369 | A | 3/1975 |
| GB | 1503407 | A | 3/1978 |
| GB | 2222399 | A | 3/1990 |
| WO | 9117090 | A1 | 11/1991 |
| WO | 9426615 | A1 | 11/1994 |
| WO | 9429186 | A1 | 12/1994 |
| WO | 9930977 | A1 | 6/1999 |
| WO | 2005056411 | A | 6/2005 |

Fig.1
PRIOR ART
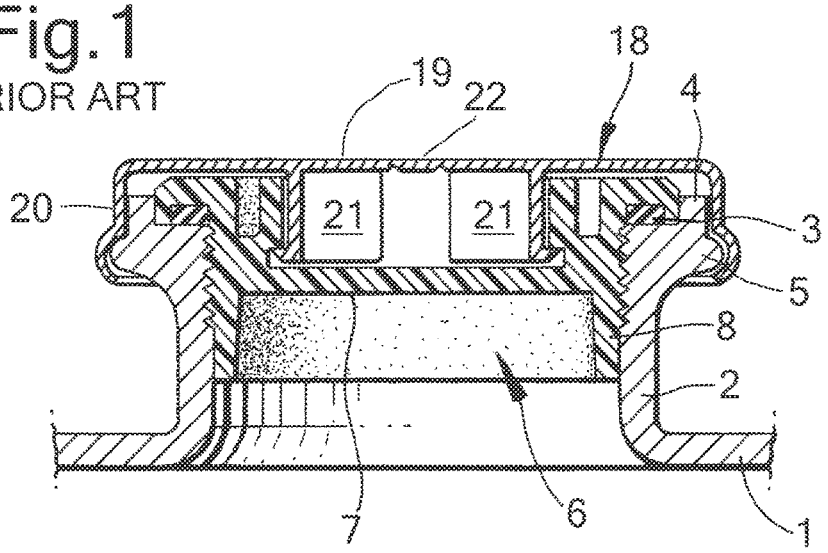
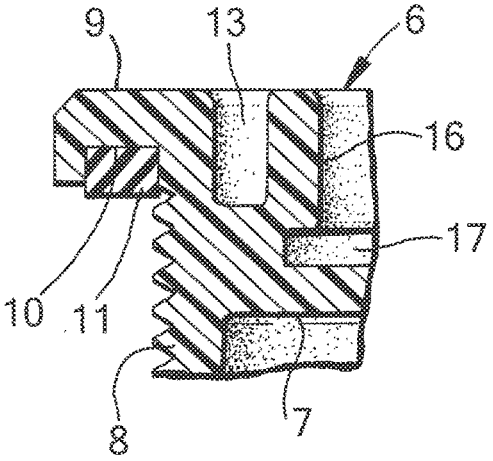
Fig.2
PRIOR ART
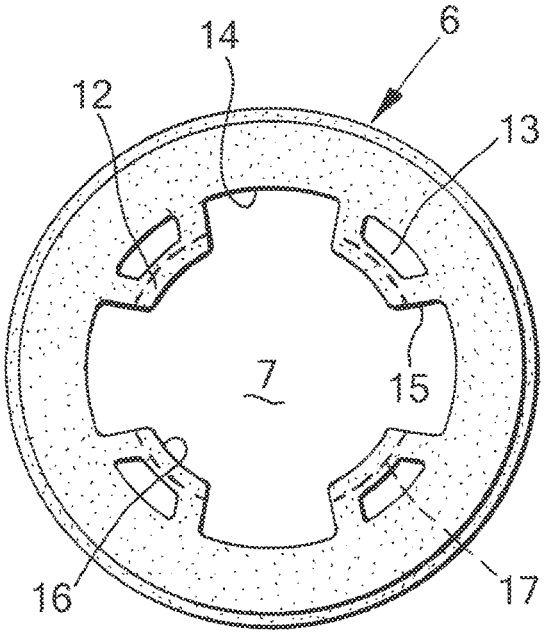
Fig.3
PRIOR ART

CLOSURE CAPS

CROSS-REFERENCE TO RELATED APPLICATIONS

This application is a continuation of U.S. patent application Ser. No. 14/456,774, filed Aug. 11, 2014, now published as U.S. Patent App. Pub. No. 2014/0346173 on Nov. 27, 2014, which is a continuation of U.S. patent application Ser. No. 12/600,162, filed Jul. 21, 2010, now issued as U.S. Pat. No. 8,813,988 on Aug. 26, 2014, which is a national stage of International Patent App. No. PCT/GB2008/001668, filed May 14, 2008, which claims priority to Great Britain patent App. No. 0709261.2, filed May 14, 2007, where the disclosure of each application is hereby incorporated by reference in its entirety.

FIELD OF THE INVENTION

This invention is directed to closure caps or overseals and is principally, but not exclusively, directed towards closure caps or overseals for closure plugs for shipping containers; such as drums.

BACKGROUND OF THE INVENTION

In today's global political climate the security of drummed products is coming under ever closer scrutiny. It has long been the practice to apply overseals of one kind or another with special hand and power tools which were able to crimp a metal portion of the overseal tightly around an upstanding opening neck designed to receive the seal. Moreover, the application step itself is quite labour intensive and relatively inefficient. Consequently a number of hand applied overseals or caps have come forth which to a certain degree obviate the above-mentioned application tools. These hand-applied overseals are for the most part easily snapped onto the container opening neck and usually almost as easily snapped off. While these plastic snap-on caps or overseals serve to dress up a container such as a 55 gallon (275 liter) drum, giving the closure area a finished appearance and some added degree of cleanliness, there is still much to be desired in terms of drum security. To be effective such drum closure caps or overseals need to meet a number of rather demanding criteria. Obviously the hand application has to be simple and relatively effortless to satisfy normal filling line speeds. Once the drum is shipped, of paramount importance is the ability of the cap or overseal to guard against unauthorized access to the drum contents. This means that the cap or overseal cannot be physically removed without destroying same or making such unauthorized access clearly noticeable and such that the cap or overseal cannot be reapplied in unaltered form to the drum closure. In this regard, plastic, manually-applied caps or overseals currently in general use for both steel and plastic drums are, for the most part, easily pried off in an undetected manner particularly when in a warmed state. In other words "easy-on easy-off".

A performance criterion also of major importance is the ease with which the cap or overseal can be removed from the underlying drum closure in an authorised manner such that subsequent replacement of the overseal is not possible. Normally this requires destruction of the cap or overseal in some fashion to prevent reuse. In this regard the use of sharp cutting or puncturing implements is undesirable due to the likelihood of injury or of accidental damage to the underlying closure. Thus, in addition to the overseal's robust construction, hand removability is yet another advantageous attribute.

PRIOR ART

A known closure plug and overseal closure combination is illustrated FIGS. 1 to 3, wherein a wall 1 of a container, such as an industrial size plastic drum, has an upstanding neck 2 defining an internally threaded opening in the container wall. The neck 2 terminates at its upper end in an annular gasket seat 3 surrounded by an upstanding collar 4. Immediately beneath the collar 4 is a peripheral annular bead 5.

A cup shaped closure plug 6, having a bottom wall 7 and an externally threaded sidewall 8, is screwed into the neck 2. The plug has a circumferentially enlarged head 9 with a gasket retaining groove 10 and resilient sealing gasket 11 on the undersurface thereof. Looking at the top surface of the plug in FIG. 3, there are a series of four equally spaced wrench engaging lugs 12 which are hollowed out as indicated at 13. Also, it can be seen that the width of the lugs 12 is slightly less than the width of the gaps 14 therebetween. Each lug has two radially extending wrench engaging surfaces 15 and a radially inwardly facing guide surface 16. The base of each lug 12, where it joins the plug bottom wall 7, is radially undercut to form a locking groove 17 designed to interlockingly engage a closure cap or overseal 18.

Cap 18 covers the plug 6, so that access to the plug, particularly to wrench engaging lugs 12, is prevented. The cap 18 also protects the closure plug 6 and the container neck 2 against ingress of liquid, dust or dirt. The cap 18 consists of an imperforate cap moulded of synthetic plastic resin having a disc-like top wall 19 surrounded by a peripheral depending skirt 20. A segmented collet depends from the central portion of the cap made up of a series of axially elongated leg segments 21. A tear strip 22 is formed in the cap and is defined by a pair of score grooves extending diametrically across the top wall 19 and down the skirt 20.

Document U.S. Pat. No. 3,838,785 (LANCESSEUR) discloses a tamper-proof cap for containers having a bead or screw-threads, the cap comprising a flat-bottom having a skirt formed with an inner bead for engagement on the neck of the container, and a capsule covering completely said cap with its bottom and outer skirt, said capsule being formed with a central disk connected by easily breakable means to the periphery of the bottom of said capsule, said disk being adapted to be resiliently retained in a central cavity of the cavity of said cap.

Document WO-A-2005/056411 (AMERICAN FLANGE & MFG. CO INC) discloses a closure combination of a closure plug for shipping containers and a tamper evident, closure overseal, the closure plug (6, 45) and the overseal (20, 52) having hidden, complementary, interlocking, snap-fit features (17, 49, 23, 56, 24, 57) and a frangible, tear-strip portion (26, 53*a*), to permit removal of the overseal from the plug, that is visible when the closure plug and the overseal are interlocked; the interlocking, snap-fit features may be internal or external of the closure plug but are hidden by the overseal skirt (22, 54) and the overseal is destroyed on removal from the closure cap.

Document EP-A-0725013 (LAWSON MARDON SUTTON LTD) discloses a cap for a keg spear having internal teeth (13), which snap-engage over an annular projection on the spear. A tamper-evident ring (40) is provided on the cap skirt (12) and connected to the skirt by frangible radial tags (41) having point-to-point attachment to the skirt. The ring obstructs access to the skirt for levering off the cap, so that any such attempt loosens the ring by breaking the tags to provide tamper evidence. The ring (40) is securely fixed to a tear strip (30,31), defined by a pair of grooves of weakness extending axially in the skirt (12) and radially across the top (11) of the cap. The ring (40) can be used as a handle to split the cap for removal in one piece and is securely attached to the skirt (12) by a bridge (30).

Document GB-A-1386369 (WASSILIEFF) discloses a tamperproof container closure has an element A with an internal annular projection 5 which forms a skirt for sealing with a container neck. An element B is axially movable so that when it is pressed down the bevelled face 12 slides over the annular projection 4 thus compressing the sealing lip 5. At the same time the washer 17 which is integrally moulded with the top 10 rides over a central peg 6 so that the flange 7 engages on the top of edge 23 thus imprisoning the washer 17 under the flange 7. To open the container element R is pulsed upwards thus freeing the projection 4 for unsealing the container top and at the same time the washer 17 breaks along the rupture points (20), and falls on the top 1. When the element B is lowered to reseal the container, a difference in level exists between the top 10 and the washer 17, thus indicating that unsealing has taken place.

Document EP-A-1342671 (TOMASELLA) discloses a closure device (1) particularly usable for temporarily closing a container for liquids, comprising a first cap (4), which is provided with first elastically deformable elements (6) for connection to the outer neck of the container; a second coaxial and external cap (5) being slidingly and selectively associated with the first cap and comprising second elements for the temporary activation of the first elements and third elements suitable to remove the closure device from the neck of the container.

In closures of the type disclosed in AMERICAN FLANGE & MFG. CO INC or LAWSON MARDON SUTTON LTD the cap is removed from the closure by means of a tear strip extending essentially diametrically across the whole of the cap top so that, on tearing the strip, the cap is divided in, or nearly in, two.

The problem with the closures of the type described in LANCESSEUR, WASSILIEFF or TOMASELLA is that the frangible attachment means (disk 12, washer 17, disc 30 or plate 24) are centred in the cap top and break away, i.e. fall loose entirely, upon removal of the cap from the closure. Additionally, these frangible attachment means are located beneath the cap top leaving a permanent central aperture in the cap and the cap unsealed.

OBJECT OF INVENTION

It is an object of the present invention to provide a cap having frangible attachment means that retains the attachment means upon removal of the cap from a container closure or plug.

SUMMARY OF INVENTION

According to the present invention, a cap for a container comprises:

a) a cap top;

b) attachment means under the cap top and securingly engageable with a given container;

c) a frangible connection between the cap top and the attachment means designed, in use, to be broken upon removal or attempted removal of the cap from said container; and, d) a permanent connection provided between the cap top and the attachment means which, upon breaking of the frangible connection, retains the cap top and the attachment means relatively moveably connected together.

A cap in accordance with the present invention differs from known prior art caps, covers or overseals by having frangible attachment means with a permanent connection that prevents the attachment means from being lost, discarded or falling into the container.

According to an embodiment of the present invention, the cap is a cap for a container closure and the attachment means has a snap-fit engagement with a feature of the container closure or a closure plug.

According to another embodiment of the present invention, the attachment means is a ring depending axially from and frangibly connected to the cap top. The attachment ring may be axially separated from the cap top by a series of frangible links and the permanent connection may bridge the axial separation between the cap top and the attachment ring.

According to a still further embodiment of the present invention, the permanent connection includes a tear-strip defined by membranous grooves of weakness in the upper surface of the cap top to leave the upper surface of the cap unbroken and essentially flat. A cap in accordance with this embodiment can seal a container closure or closure plug.

DESCRIPTION OF THE DRAWINGS

The above and further features of the present invention are illustrated, by way of example, the following description and drawings; wherein:

FIG. 1 is a vertical cross sectional view of a prior art closure combination;

FIG. 2 is an enlarged fragmentary sectional view of the plug wrench engaging lug of the closure plug of FIG. 1;

FIG. 3 is a top plan view of the closure plug of FIG. 1;

SPECIFIC DESCRIPTION

Figure 4:
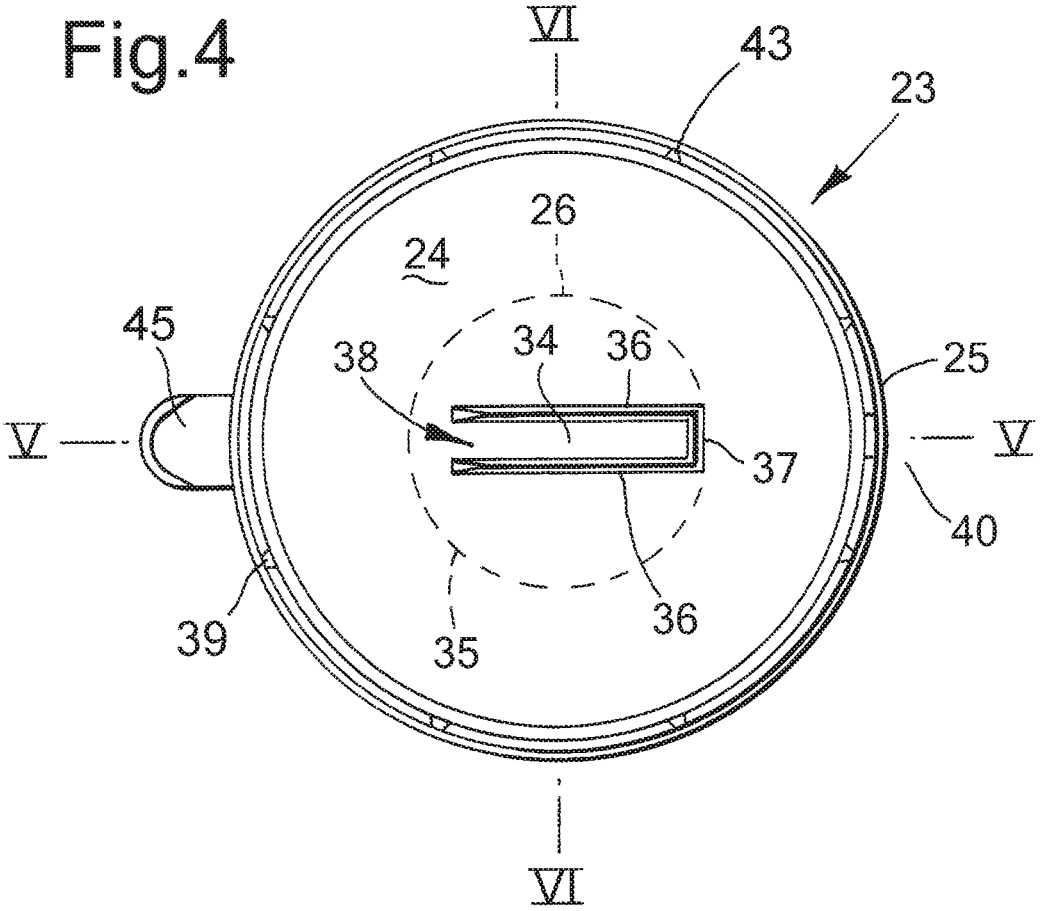
FIG. 4 is a plan of a tamper-evident cap in accordance with an embodiment of the invention.
Figure 5:
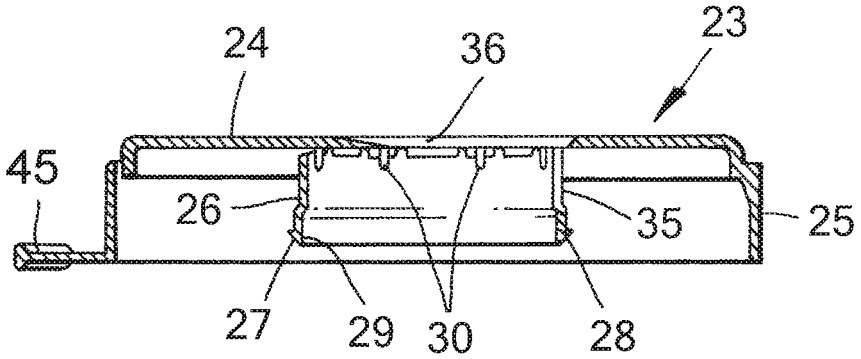
FIG. 5 is a section on the line V-V of FIG. 4.

A tamper-evident cap in accordance with an embodiment of the present invention is illustrated by FIGS. 4 to 9 and consists of an imperforate cap 23 moulded of synthetic plastic resin having a disc-like top 24 surrounded by a peripheral depending skirt 25. An attachment ring 26 depends from the central portion of the cap top 24 and terminates at its bottom rim 27 in a radially outwardly projecting flange 28 having a radial cam surface 29. The attachment ring 26 is designed as a snap-fit within closure plug 6; in use cam surface 29 meets the closure plug lugs 12 and deflects/distorts the ring radially inwardly sufficiently for the ring to pass within the lugs and the ring flange 28 to snap-engage as a tight fit in the locking groove 17.

The cap 23 and the attachment ring 26 are formed as a single moulding with the ring axially separated from the cap top 24 by a series of frangible links 30 and an essentially non-frangible or permanent connection 31. As shown more clearly in FIG. 8 each link 30 comprises an integrally moulded post 32 upstanding from the attachment ring top rim 33 with the upper end of each post 32 integral with and frangible from the lower surface of cap top 24. In the embodiment, there is a circular series of eight frangible links 30 between the cap top 24 and the attachment ring 26.

Figure 6:
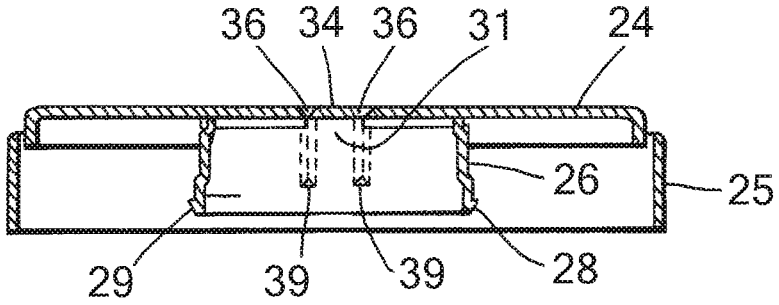
FIG. 6 is a section on the line VI-VI of FIG. 4.
Figure 7:
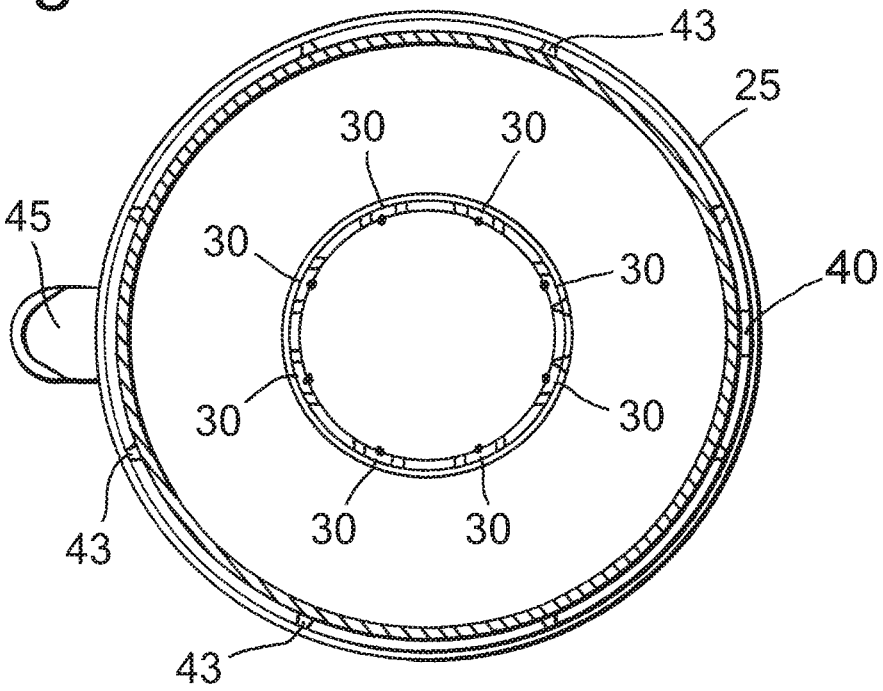
FIG. 7 is a sectional underplan of the cap of FIG. 4.
Figure 8:
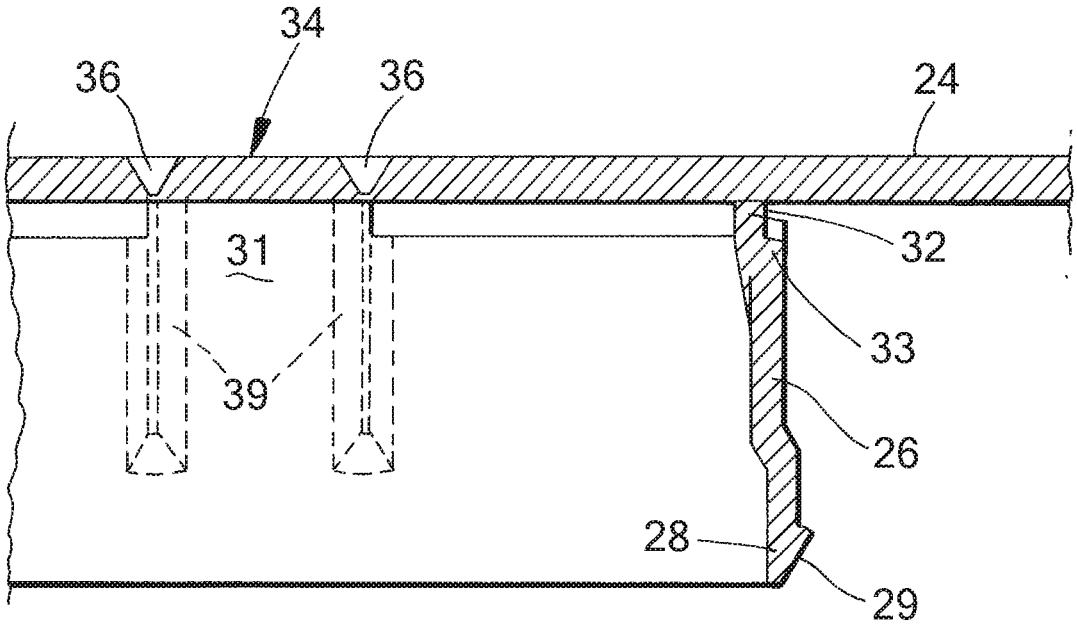
FIG. 8 is an elevational detail illustrating the frangible and tear strip connections between the cap top and the attachment ring of the cap of FIG. 4; and, FIGS. 9*a,b,c* are perspective views showing the removal of the cap of FIG. 4 from a container neck.

A tear-strip 34 extends diametrically of the central region 35 and part way across cap top 24, above and within the circle of frangible links 30, and is formed by a pair of parallel frangible membranous side grooves 36 in the cap top 24 with a further frangible membranous cross groove 37 linking grooves 36 at one end of tear strip 34. As can be seen in FIGS. 6 and 8, the permanent connection 31 links the end of the tear strip adjacent to cross groove 37 to the attachment ring 26. The frangible grooves 36 continue as a pair of parallel frangible membranous grooves 39 extending from the permanent connection 31 and part-way only down the attachment ring 26; such that this region of the attachment ring 29 forms an integral extension 30 of the tear-strip 34. This integrity is due to the geometry of the cap top tear strip grooves 36, the permanent connection 31 and the attachment ring tear strip grooves 36.

The upper surface of the cap 23 is unbroken and essentially flat, save for the membranous grooves 36, 37 and 38. This enables the cap 24 both to seal a container closure or closure plug, functioning as a capseal, and enables text such as advertising matter, logos, etc. to be applied to or printed on the upper surface of the cap with little or no distortion.

The cap 23 can be fitted to the closure plug 6 simply by pressing the cap down onto the closure plug; this can be achieved manually or by use of a specially shaped tool (not shown). There is no need to align the cap attachment ring with the closure plug lugs.

Figure 9A:
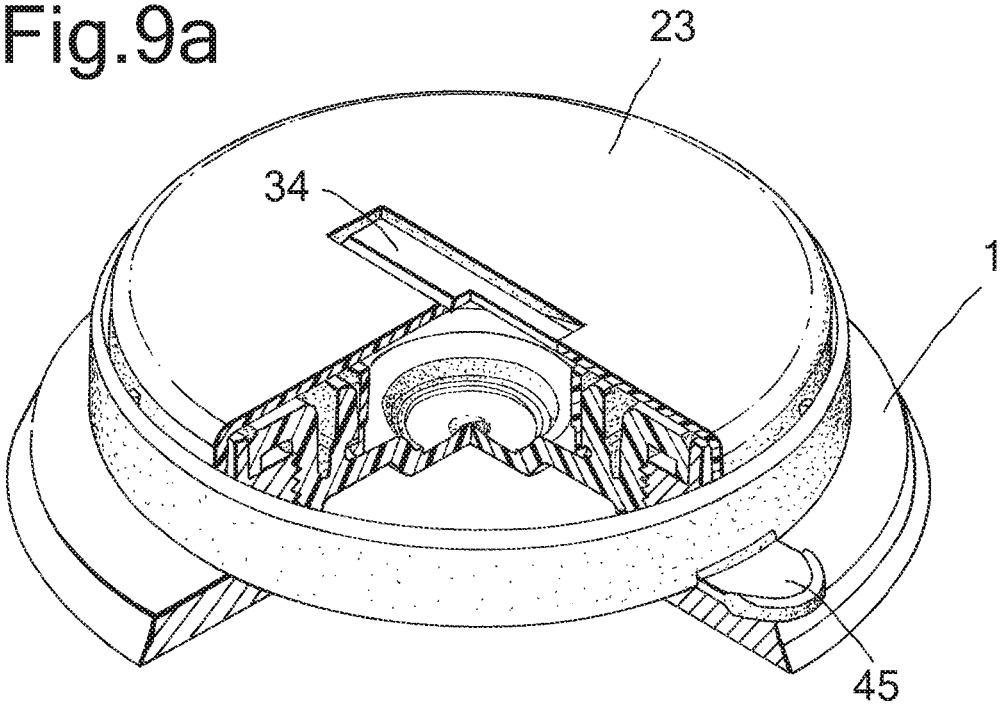
Figure 9B:
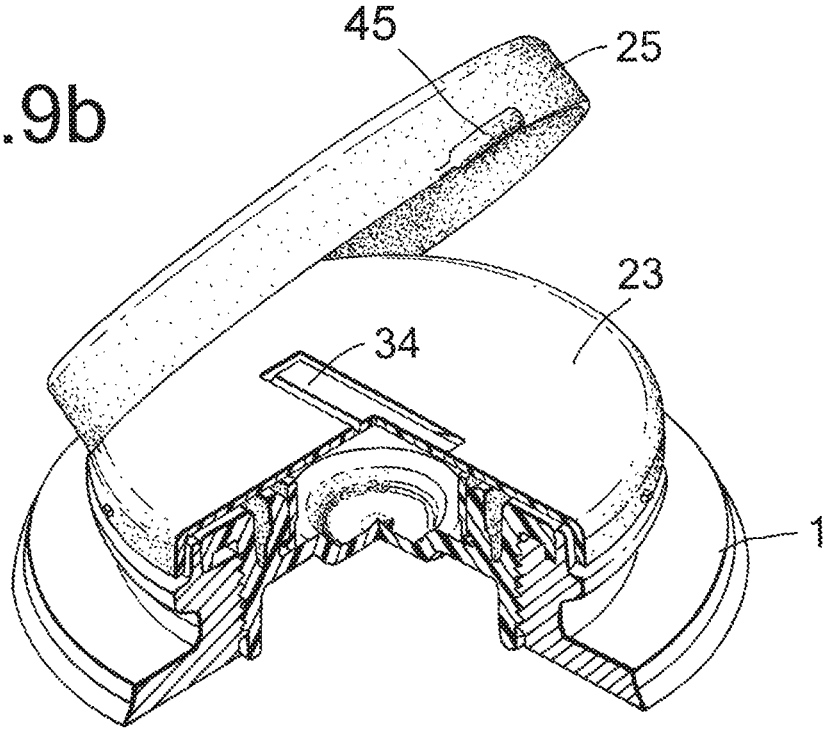
Figure 9C:
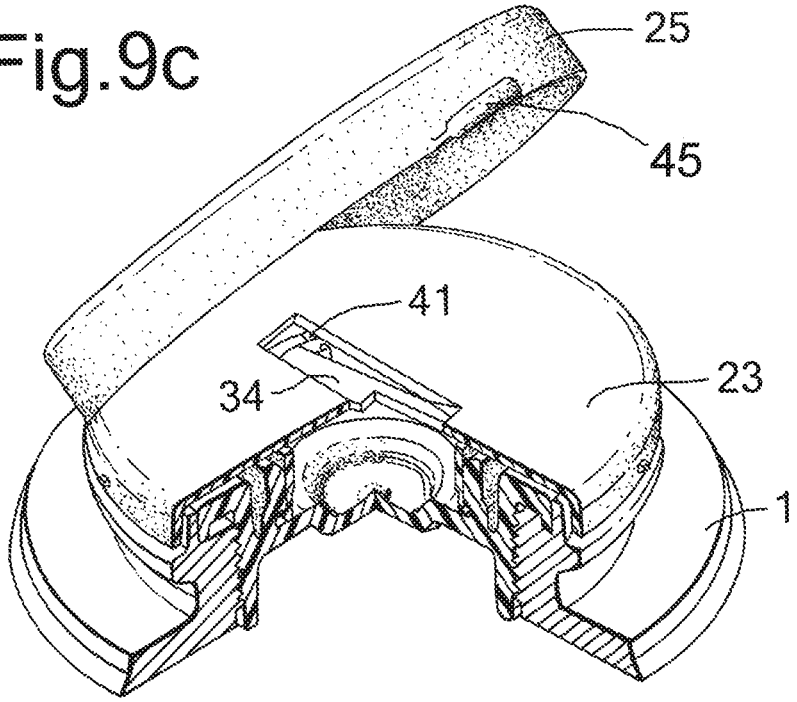

In use and as illustrated by FIGS. 9*a,b,c*, removal or attempted removal of the cap 23 from the closure plug 6 will fracture the links 30 and frangible grooves 36, 37 the tight-fit snap-fit engagement between the attachment ring and the closure plug 6 being stronger than the tear strength of links 30 and grooves 36, 37 so that the force required to disengage the attachment ring 26 from the closure plug 6 is greater than that required to fracture links 30 and grooves 36, 37. As the cap 23 is lifted off the closure plug, the cap top 24 will detach from the attachment ring 26 and the tear strip 34, leaving a visible, tamper-evidencing, rectangular aperture 41 in the cap top centre region 35. The cap top 24 will remain relatively moveably connected to the attachment ring 26 by the tear-strip 34; top end 38 of tear strip 34 forming part of cap top 24 whilst the bottom end of tear strip 34 and permanent connection 31 forms part of the attachment ring 26.

Continued removal of the cap top from the closure plug will tear the attachment ring grooves 39, leaving an aperture in the ring wall that permits of deflection/distortion of the attachment ring 26, to enable the ring flange 28 to disengage from the closure plug locking groove 17. Cap top 24 and attachment ring 26 will remain connected together after removal from the closure plug.

Cap skirt 25 is attached, as illustrated in Document EP-A-0725013, to the cap top 24 by a series of frangible ties 43 and includes an integral strap 40 between the skirt and the cap top; an integral tab 45 extends radially outwardly from the skirt. In use and as shown by FIGS. 9*a,b* and *c*, the tab is pulled upwardly to fracture the ties 43 so that the skirt 25 forms a ring handle attached by strap 40 to the cap top 24 to assist removal of the cap from the closure plug 6.

The present invention has been illustrated with reference to caps snap-fitted to closure plugs, but it can provide a permanent connection for any cap having frangible means of attachment to a container, wherein a frangible connection can extend between the attachment means and the cap top.

The invention claimed is:

1. A cap for a container closure or closure plug, the cap comprising:

a cap top having a top surface and a bottom surface; and an attachment ring extending axially downward beneath the bottom surface of the cap top under a central portion of the cap top, the attachment ring being securingly engageable with a container closure or closure plug, wherein the attachment ring comprises a cam surface extending radially outward from the attachment ring, the cam surface being configured to deflect the attachment ring radially inward upon engagement of the attachment ring with the container closure or closure plug, and wherein the cap top and the attachment ring are connected by at least one frangible connection and at least one permanent connection, the at least one permanent connection being configured to retain the cap in one piece upon breaking of the at least one frangible connection for removal of the cap from the container closure or closure plug.

2. The cap of claim 1, wherein the cam surface is configured to be securingly engageable with the container closure or closure plug.

3. The cap of claim 2, wherein the attachment ring has a snap-fit engagement with the container closure or closure plug.

4. The cap of claim 3, wherein the cam surface is configured to be received within a locking groove of the container closure or closure plug.

5. The cap of claim 1, wherein the attachment ring comprises a top portion and a bottom portion, and the cam surface extends radially outward from the bottom portion of the attachment ring.

6. The cap of claim 5, wherein the at least one frangible connection is located at the top portion of the attachment ring.

7. The cap of claim 6, wherein the at least one permanent connection extends between the bottom portion of the attachment ring and a tear strip extending at least partially within the cap top.

8. The cap of claim 1, wherein the at least one frangible connection is configured to be broken upon attempted removal of the cap from said container closure or closure plug.

9. The cap of claim 8, wherein a visible tamper indication is left following breakage of the at least one frangible connection.

10. The cap of claim 1, wherein the at least one permanent connection comprises a tear strip extending at least partially within the cap top.

11. The cap of claim 10, wherein the tear strip is defined at least in part by side grooves in the top surface of the cap top.

12. The cap of claim 11, wherein the remainder of the top surface of the cap top outside of the tear strip is unbroken following tearing of the tear strip for removal of the cap.

13. The cap of claim 11, wherein the side grooves are membranous.

14. The cap of claim 11, wherein the side grooves continue as a pair of parallel frangible membranous grooves extending part-way down the attachment ring.

15. The cap of claim 14, wherein the pair of parallel frangible membranous grooves extend part way down the attachment ring from a portion of the permanent connection which connects the attachment ring to the tear strip.

16. The cap of claim 14, wherein the pair of parallel frangible membranous grooves, when torn, weaken the attachment ring to permit removal of the attachment ring from the container closure or closure plug.

17. The cap of claim 1, wherein the force required to disengage the attachment ring from the container closure or closure plug is greater than the force required to break the at least one frangible connection.

18. A combination comprising a container, a closure plug and an overseal cap, the combination comprising:

the container comprising an upstanding neck;

the closure plug connected to the container, the closure plug comprising:

a bottom wall;

a sidewall configured to engage with the upstanding neck of the container; and a plurality of lugs extending axially upward from the bottom wall, each of the plurality of lugs comprising a radially inwardly facing guide surface and a locking groove at a base of each lug;

the overseal cap comprising:

a cap top having a top surface and a bottom surface; and an attachment ring extending axially downward beneath the bottom surface of the cap top under a central portion of the cap top, wherein the attachment ring comprises a cam surface extending radially outward from the attachment ring, the cam surface being receivable within the locking groove at the base of each lug whereby the attachment ring is securingly engageable with the closure plug, wherein the cam surface is configured to deflect the attachment ring radially inward upon engagement of the attachment ring with the radially inwardly facing guide surface of the closure plug, and wherein the cap top and the attachment ring are connected by at least one frangible connection and at least one permanent connection, the at least one permanent connection being configured to retain the overseal cap in one piece upon breaking of the at least one frangible connection for removal of the overseal cap from the closure plug.

19. The combination of claim 18, wherein the radially inwardly facing guide surface of the closure plug comprises a top portion and a bottom portion, the bottom portion extending radially inward relative to the top portion.

20. The combination of claim 19, wherein the bottom portion of the radially inwardly facing guide surface of the closure plug comprises an upper flank which slopes radially inward in a downward direction.

21. The combination of claim 18, wherein the upstanding neck of the container comprises internal threads and the sidewall of the closure plug comprises external threads that are configured to be threaded with the internal threads of the upstanding neck to engage the closure plug with the upstanding neck of the container.

22. The combination of claim 18, wherein the attachment ring comprises a top portion and a bottom portion, and the cam surface extends radially outward from the bottom portion of the attachment ring.

23. The combination of claim 18, wherein a visible tamper indication is left following breakage of the at least one frangible connection.

* * * * *